US007431622B2

(12) United States Patent
Haun

(10) Patent No.: US 7,431,622 B2
(45) Date of Patent: Oct. 7, 2008

(54) FLOATING BERTH SYSTEM AND METHOD

(76) Inventor: Richard D. Haun, 21411 Park Post Oak La., Katy, TX (US) 77450

( * ) Notice: Subject to any disclaimer, the term of this patent is extended or adjusted under 35 U.S.C. 154(b) by 331 days.

(21) Appl. No.: 11/148,496

(22) Filed: Jun. 9, 2005

(65) Prior Publication Data

US 2005/0277344 A1 Dec. 15, 2005

Related U.S. Application Data

(60) Provisional application No. 60/578,669, filed on Jun. 10, 2004.

(51) Int. Cl.
*B63B 22/02* (2006.01)
*B63B 21/00* (2006.01)

(52) U.S. Cl. ..... 441/3; 114/230.1

(58) Field of Classification Search ..... 441/3–5; 114/230, 230.1, 230.13, 230.14, 230.2, 230.27, 114/258, 264, 266
See application file for complete search history.

(56) References Cited

U.S. PATENT DOCUMENTS 3,163,147 A * 12/1964 Collipp ..... 114/265
4,414,911 A 11/1983 Belinsky ..... 114/219
5,154,561 A * 10/1992 Lee ..... 414/138.3
6,089,022 A 7/2000 Zednik et al. ..... 60/641.7
6,176,191 B1 1/2001 Fernandez et al. ..... 114/142
6,298,671 B1 10/2001 Kennelley et al. ..... 62/50.2
6,546,739 B2 4/2003 Frimm et al. ..... 62/50.2
2001/0036387 A1* 11/2001 Richter et al. ..... 405/195.1
2003/0068203 A1* 4/2003 Khachaturian ..... 405/200
2004/0216485 A1* 11/2004 Landry et al. ..... 63/3.1
2005/0193938 A1* 9/2005 Boatman et al. ..... 114/230.1

OTHER PUBLICATIONS

Capt. A.G.W. Miller, Dictionary of Nautical Words and Terms, 1998, Revised 4th Edition (Reprinted), Glasgow Brown, Son & Ferguson, Ltd., Nautical Publishers, p. 66.*

* cited by examiner

*Primary Examiner*—Jesus Sotelo
*Assistant Examiner*—Daniel V Venne
(74) *Attorney, Agent, or Firm*—Wilson D. Swayze, Jr.

(57) ABSTRACT

A berthing facility and method of docking a maritime vessel that features greatly improved stability and is suitable at a wide range of depths. The floating berth is made up of a plurality of buoy components protected by a fendering assembly which constitutes the breasting and mooring dolphins of a conventional fixed berth. The fendering assembly presents shock-absorbing fender panels that help absorb the impact from docking ships, the combined system allowing absorption of large berthing energies with reduced reactions and greater safety. The buoy components are preferably each of a type known commercially as a Satellite Separator Platform (SSP).

13 Claims, 4 Drawing Sheets

FLOATING BERTH SYSTEM AND METHOD

This application claims priority to U.S. Provisional Patent application Ser. No. 60/578,669 filed Jun. 10, 2004.

BACKGROUND OF THE INVENTION

1. Field of the Invention

The invention relates generally to improved methods and systems for offshore mooring of vessels. In particular aspects, the invention relates to improved methods of configuring a berth and systems for docking maritime vessels at an offshore location. The berth may be used for the following purposes: loading or unloading of cargo; unloading of passengers; refueling or maintenance and repair of maritime vessels. Maritime vessels, in the context used, include naval or commercial ships, barges, tugs, offshore floating platforms and specialty vessels used for the offshore industries.

2. Description of the Related Art

An effective berth requires that the floating dock be able to sustain large forces from docking vessel impacts, winds, waves, and currents against the maritime vessel while it is at berth. The berthing arrangement must also permit the safe transfer of cargo, passenger crew, and components for maintenance or provisions from the maritime vessel to the floating dock. Additionally, a tanker captain or harbor pilot must be comfortable or somewhat familiar with the berthing facility in order to safely maneuver the ship and prevent novel and unfamiliar docking procedures to be used. The berthing facility should be economical, thereby allowing its construction and installation without undue expense that might otherwise eliminate or limit its practical use.

Although floating docks are commonly used for docking of pleasure craft in yacht marinas, such an arrangement would not be suitable for use in deep water or for use with the offloading and loading of dangerous cargos in deeper areas farther from shore and from the general populace. The offshore application of a floating berth must account for required durability and safety.

Known berthing arrangements for maritime vessels at sea are not optimal and include inherent risks during transfer of hazardous cargo. U.S. Pat. No. 6,546,739 issued to Frimm et al., for example, teaches a floating platform, such as a modified very large crude carrier (VLCC) that is tethered to a turret system or a CALM buoy, that is moored in place. The tether connection is a single-point mooring that allows for "weathervaning," or movement of the tanker about that mooring point during current, waves or wind changes. Such movement of the tanker during offloading or during sensitive cargo transfer to another vessel is problematic because the relationship between the tankers can change quickly and such an arrangement may become substantially unstable in poor weather or sea conditions.

SUMMARY OF THE INVENTION

The present invention provides an improved berthing facility and method of docking a maritime vessel. The invention features greatly improved stability and is suitable at a wide range of depths. In an exemplary embodiment, the floating berth is made up of a plurality of buoy components that are arranged in a linear fashion and protected by a fendering assembly which constitutes the breasting dolphins of a conventional fixed berth. The fendering assembly presents shock-absorbing fender panels that help absorb the impact from docking ships. The buoy components are preferably each of a type known commercially as a Satellite Separator Platform (SSP) and include a center column assembly, the position of which may be altered as needed for movement of the SSP or for stationary placement. The floating berth is moored in place to the sea floor and, preferably, is provided with bow and stern buoys, for added anchorage and stability, which constitute the mooring dolphins of a conventional fixed berth. The general configuration, which constitutes a floating berth, is a central embodiment of the invention. The fendering system provided on the berth, which is an embodiment of the present invention, provides a degree of adjustment to improve fendering efficiency over a wide range of hull shapes thereby reducing local ship side panel loads and improving safety against ship damage. A related aspect of the present invention is the use of deep set fendering which tends to cause the primary reactions to occur closer to the ship keel thereby preventing overturning moments on the floating berth components.

In practice, a ship, tanker, or other maritime vessel, is docked in a stable parallel relation to the floating berth, which facilitates safe conduct of a cargo, personnel or equipment transfer, or maintenance procedures. The lowered center column assemblies of the SSP's within the docking platform provide exceptional stability for the floating platform and allow means of gangways and personnel access between the individual buoys which are a further aspect of the present invention.

BRIEF DESCRIPTION OF THE DRAWINGS

For further understanding of the nature and objects of the present invention, reference should be made to the following drawings in which like parts are given like reference numerals and wherein.

DETAILED DESCRIPTION OF THE PREFERRED EMBODIMENTS

Figure 1:
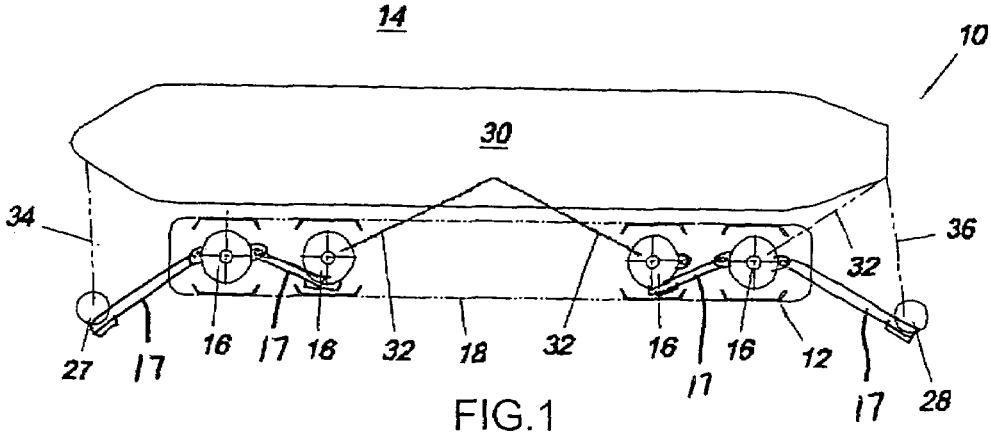
FIG. 1 is a plan view depicting a tanker that is docked at an exemplary floating berth constructed in accordance with the present invention.

FIGS. 1-6 depict an exemplary floating berth and mooring arrangement, generally indicated at 10, which incorporates a longitudinal floating berth or docking facility 12. The floating berth 12 is located in an area of ocean 14 that is remote from shore. The floating berth 12 is made up of a plurality of buoys 16 that support a protective fendering arrangement 18. These buoys 16 are used as breasting and mooring dolphins which react against the side of a ship to hold it in position. While there are four buoys 16, shown in FIGS. 1 and 2, those of skill in the art will understand that there may be more or fewer breasting and mooring buoys, as necessary or desired for stability of the maritime vessel. The linear arrangement of the buoys 16 as well as desired spacing may be maintained by a suitable system of lashings, struts and the like (not shown) but exemplified by the outline of fendering arrangement 18 on FIG. 1. The floating berth 12 is preferably provided with suitable walkways 17 (see FIGS. 1 and 6), as well as stanchions and lines (such as lines 32) necessary for securing of a maritime vessel thereto. The floating berth 12 may be provided with loading equipment for the handling and processing of liquids, gases and solids or for other cargo that might be transported by a tanker or vessel. At the ends of the breasting buoys, other buoys 27 and 28 may be provided for attaching ship bow and stern lines. These buoys 27, 28 then function as mooring dolphins.

The buoys 16, 27 and 28 are preferably Satellite Separator Platform (SSP) floating vessels. The SSP vessel is also marketed commercially by OPE, Inc. and its affiliated companies located in Houston, Tex. Basically, the SSP vessel includes a floating hull 20 portion with a center column assembly 22 that may be extended or retracted vertically downwardly into the sea 14 to provide improved stability while floating. An SSP vessel is generally suitable for water depth applications from approximately 100 feet to approximately 10,000 feet. The center column assembly 22 may be used to store ballast or other materials including fire fighting chemicals or hazardous chemicals to protect them from any marine vessel impact.

Figure 2:
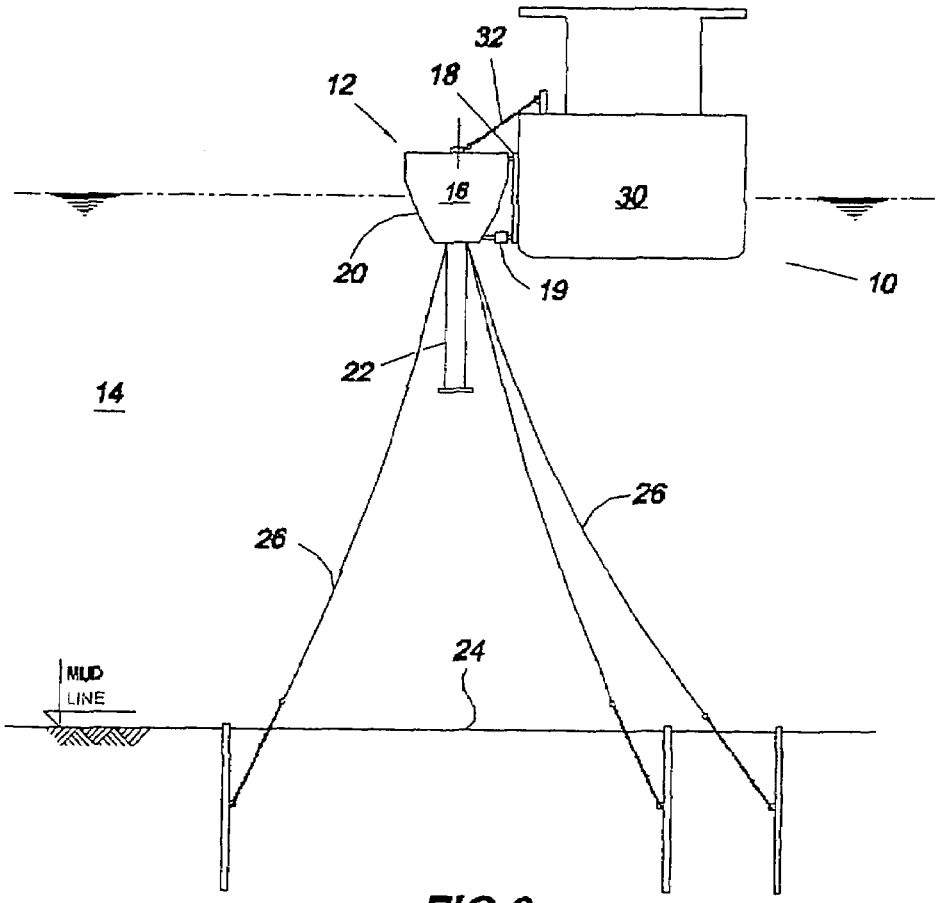
FIG. 2 is an end view of the berth arrangement shown in FIG. 1.

The fendering arrangement 18 is a system of bumpers and/or shock-absorbing panels that surround the buoys 16. The fendering arrangement 18 also serves to present the buoys 16 in a substantially linear arrangement as a flat-faced dock. FIG. 2 depicts an end view of a fendering arrangement 18 on a breasting buoy 16 and indicates the means to alter the angle of the fendering arrangement 18 by the fender adjustments 19. As can be seen in FIG. 2, the fendering arrangement 18 is deep set below the surface of the water 14 so that lower portions of the hull of the vessel 30 may be engaged by the fender 18 during docking. The fender adjustments 19 may be threaded adjustment bolts or other devices known in the art capable of adjusting the angle of the fendering arrangement 18 with respect to the adjacent buoy 16. By providing such adjustments at added portions of the fendering arrangement 18, the orientation of the fendering arrangement 18 can be made to match the hull of a docking tanker or other maritime vessel 30. Each of the buoys 16 is moored to the ocean floor 24, as depicted in FIG. 2, by mooring lines 26. There is a bow buoy 27 and a stern buoy 28 located at either end of the floating berth 12, as shown in FIG. 1. The bow and stern buoys 27, 28 are each moored to the ocean floor 24 in the same manner as the buoy components 16 of the floating berth 12. Their presence adds stability and anchorage for the berthing arrangement 10 and tanker or other maritime vessel 30.

Several docking lines 32 secure the tanker or other vessel 30 to the floating berth 12. The tanker 30 is disposed in a substantially parallel relation to the floating berth 12. This parallel docking arrangement eliminates weathervaning of the tanker 30 with respect to the floating berth 12 thereby vastly improving safety for a wide range of offshore activities. Two additional docking lines 34, 36 are used to secure the bow and stern of the vessel 30 to the bow buoy 27 and to the stern buoy 28, respectively.

Figure 3:
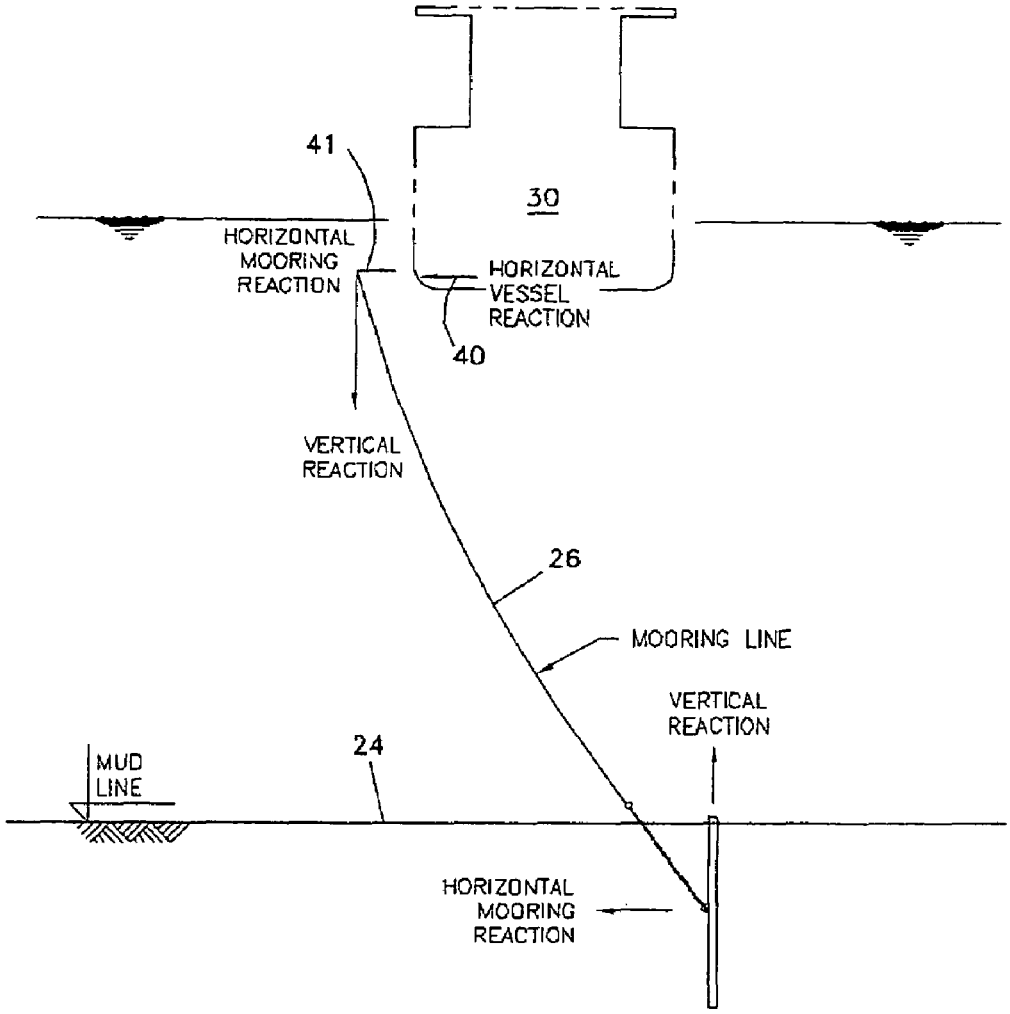
FIG. 3 is a free body diagram depicting reactions of the maritime vessel and an individual breasting buoy during docking.

FIG. 3 is a free body diagram illustrating how the deep set fendering arrangement 18 provides a reaction closer to the keel of the vessel 30. As shown, the horizontal reaction of the fendering (illustrated as arrow 41) is above that of the mooring reaction (illustrated by arrow 40). This aspect tends to cause the dock fendering arrangement 18 to match the face of the vessel 30 and improve motions. It also prevents the vessel 30 from overrunning the floating berth 12. The dock fendering being provided with fender adjustments 19, FIG. 2, maintains vertical buoy orientation under severe loading while improving the matching of well faired maritime vessel hull forms, such as LNG carriers, thereby reducing hull damage of vessels with volatile cargo. This feature increases safety for the vessel 30 and floating berth 12.

Figure 4:
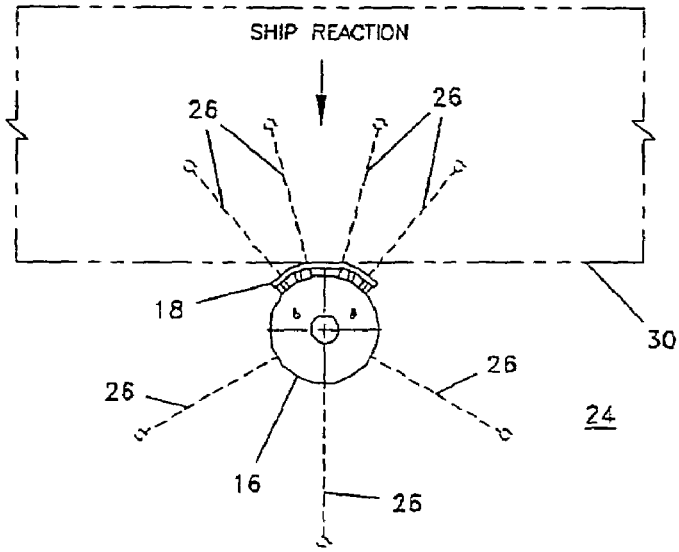
FIG. 4 is a plan view of a typical mooring pattern for a single buoy used within the docking arrangement shown in FIGS. 1-3.
Figure 5:
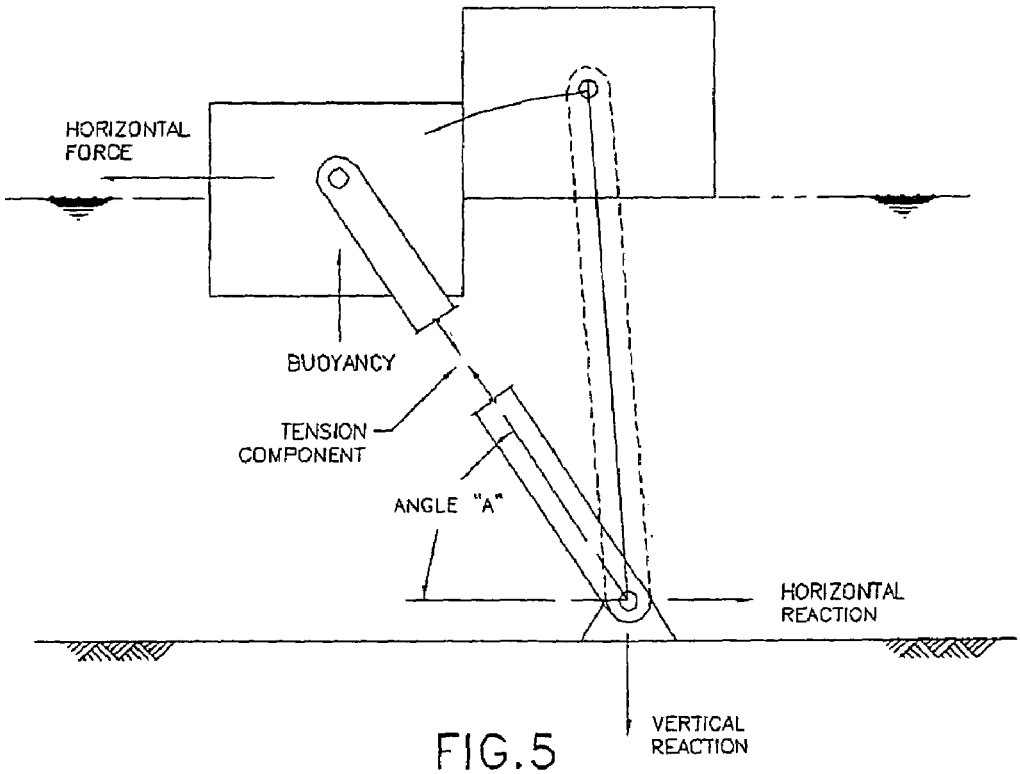
FIG. 5 is an illustration of physical forces involved in the exemplary breasting buoy arrangement shown in FIGS. 1-4.

FIG. 4 is a plan view of a single buoy 16 illustrating an exemplary anchoring arrangement of the buoy 16 to the sea floor 24. As shown, there are multiple mooring lines 26 that provide load-sharing and redundancy. By mooring the individual buoys 16 of the floating berth 12 to the seabed, the floating platform 12 is capable of absorbing significant energy from the impact of vessels, such as vessel 30, while minimizing the forces that are imparted to the side shell of the docking vessels. The energy absorption is created by the compliant system, which is created by the effective linkage of the mooring lines 26 and the reserve buoyancy of the buoys 16. FIG. 5 depicts this energy absorbing effect in a free body diagram of a simple linkage mechanism. The horizontal reaction is equal to the horizontal force to arrest the lateral motion or static forces acting on the vessel 30. The reaction to the maritime vessel 30 is equal to the buoyancy divided by the trigonometric tangent function of the angle "A" shown in FIG. 5. The energy is the calculus integral of the horizontal force taken with respect to the horizontal distance which is related to angle "A." The physical result is that the energy absorption is a result of the buoyancy offered by the breasting buoys and the angle of the reacting mooring lines. The energy absorption is increased by the amount of buoyancy implemented, therefore allowing increased lateral motion of the buoy, minimizing the horizontal reaction during impact. By utilizing buoyancy to absorb the maritime vessel reactions, the docking arrangement 10 helps to avoid damage to the vessel 30 that might otherwise result from severe winds, currents, pilot or attendant tug boat error. By providing a safe mooring away from shore and populated areas capable of many times the energy absorption of conventional breasting and mooring berths, the floating dock increases safety during loading and offloading operations of many hazardous materials and minimizes congestions and delays in busy harbors. Overly busy and congested harbors lead to difficult increases in controls for homeland security.

Figure 6:
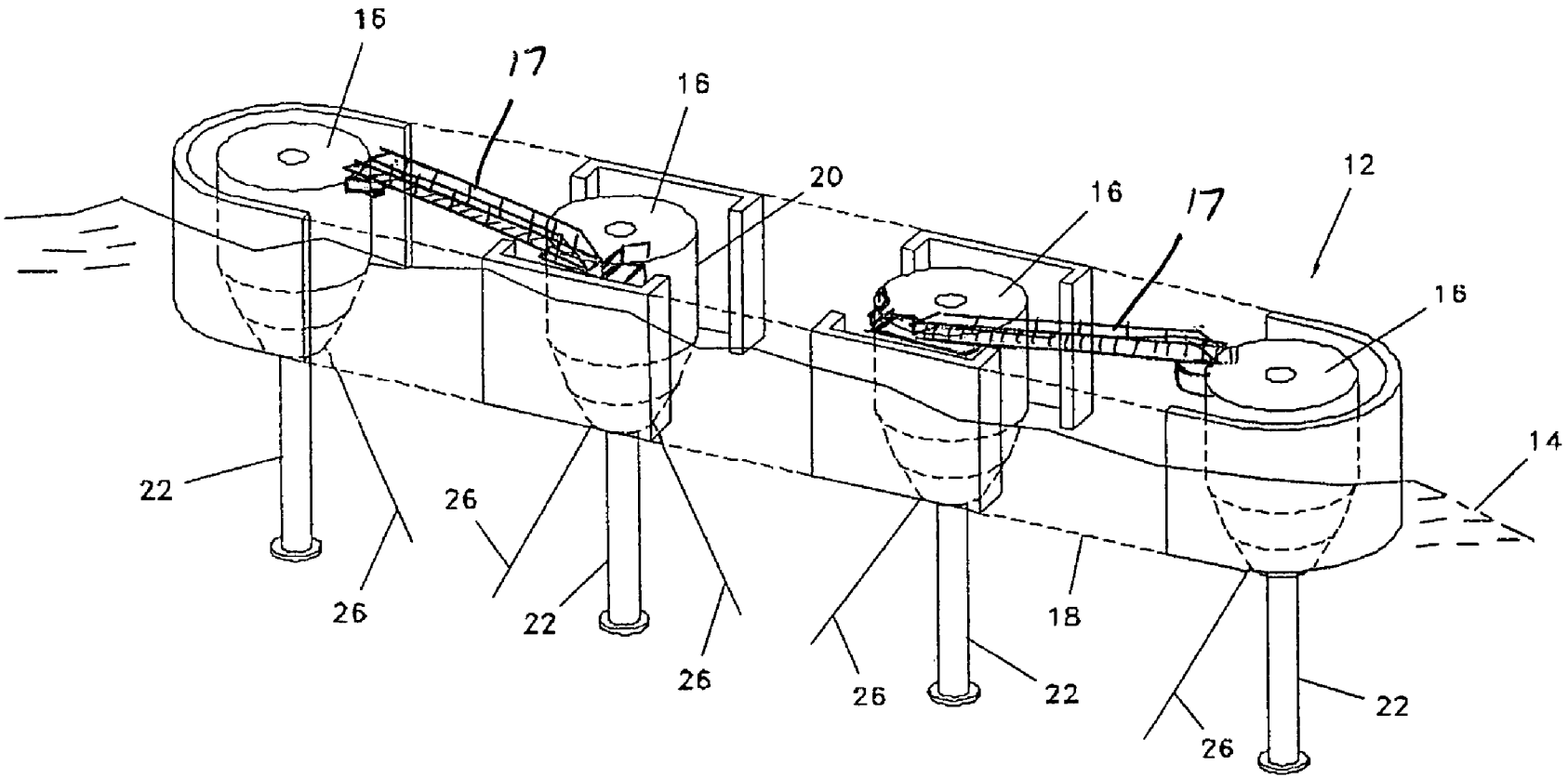
FIG. 6 depicts an exemplary floating berth constructed in accordance with the present invention as configured when emplaced at a location in the sea.

The floating berth 12, shown in FIG. 6, may be moved about by towing or by other means of propulsion. FIG. 6 depicts the floating berth 12 in a stationary position within the sea 14 wherein it may be moored in place by mooring lines 26. It is noted that the center column assemblies 22 of the buoys 16 are extended into a lowered position, so that they extend well below the hull 20 of the buoy 16. The lower portions of the center column assemblies 22 typically include weighted ballast (not shown). This adds significant stability to the floating berth 12 against wave forces that would create heave, pitch, roll or yaw motions by the platform. This feature allows for the use of walkways 17 between the buoys 16 that could be safely traveled during normal sea conditions. The use of interconnecting walkways 17 for the berthing system is a further aspect of the invention.

Propulsion systems (not shown) may be incorporated into the docking platform 12 to augment or replace the system of mooring lines 26. Supplementary thrusters with an appropriate dynamic control system may be used to minimize lateral motion or maintain station during maintenance of the floating berth 12. During transport or movement of the berth 12, the center column assemblies 22 may be raised vertically with respect to the floating hull 20 so that there is minimal drag on the berth 12 or when it is necessary to enter shallow water as a port.

As a fully contained vessel/platform, the floating berth 12 can be fabricated in virtually any construction port in the world and fully equipped prior to being towed to its installation site and, thereafter, anchored in place. It is further apparent that the floating berth principles, especially when coupled with self-propelled mobility, offer a mobile port or offshore command center which, when coupled with larger versions of the SSP or similar components, yield a series of storm stable systems for a variety of both domestic and foreign applications.

Those of skill in the art will recognize that numerous changes and modifications may be made to the exemplary systems and methods described herein without departing from the scope and spirit of the invention. In fact, the invention is intended to be limited only to the claims which follow and all permissible equivalents thereof.

What is claimed is:

1. A floating berth for use in offshore berthing of maritime vessels, comprising:

a plurality of breasting dolphins, each of said breasting dolphins comprising:

a floating hull individually moored and able to move laterally and rotate relative to other hulls;

a column assembly that extends downwardly from the floating hull and containing ballast to provide improved stability for the buoy;

a protective fendering arrangement associated with at least one of the breasting dolphins;

a bow buoy individually moored and able to move laterally and rotate relative to other hulls for attachment of a bow line from a vessel; and a stern buoy individually moored and able to move laterally and rotate relative to other hulls for attachment of a stern line from a vessel.

2. The floating berth of claim 1 wherein the column assembly can be extended or removed from below the floating hull.

3. The floating berth of claim 1 wherein the floating berth is disposed within a section of water having a surface and wherein the fendering arrangement comprises:

a fender affixed to a breasting dolphin, the fender extending below the surface of the water to engage a vessel below the surface of the water during docking; and a fender adjustment mechanism operably associated with the fender to permit angular adjustment of the fender with respect to the breasting dolphin.

4. The floating berth of claim 1 wherein the breasting dolphins are disposed in a substantially linear arrangement providing the appearance of a traditional berth to incoming vessels;

the linear arrangement being allowed to move independently to conform to the shape of the berthing vessel;

the breasting dolphins thereby able to distribute mooring reactions equally along the vessel.

5. The floating berth of claim 1 wherein there are four breasting dolphins.

6. A floating berth for use in offshore berthing of maritime vessels in an area of water having a surface, the floating berth comprising:

a plurality of breasting dolphins, each of said breasting dolphins comprising:

a floating hull individually moored and able to move laterally and rotate relative to other hulls;

a column assembly for each buoy that extends downwardly from the floating hull and containing ballast to provide improved stability for the floating berth;

a docking fender associated with the breasting dolphin and extending below the surface of the water;

a bow buoy individually moored and able to move laterally and rotate relative to other hulls for attachment of a bow line from a vessel; and a stern buoy individually moored and able to move laterally and rotate relative to other hulls for attachment of a stern line from a vessel.

7. The floating berth of claim 6 wherein the column assembly can extend from or be removed from below the floating hull.

8. The floating berth of claim 6 further comprising a fender adjustment mechanism operably associated with the fender to permit angular adjustment of the fender with respect to the breasting dolphin.

9. The floating berth of claim 7 wherein the breasting dolphins are disposed in a substantially linear arrangement providing the appearance of a traditional berth to incoming vessels;

the linear arrangement being allowed to move independently to conform to the shape of the berthing vessel;

the breasting dolphins thereby able to distribute mooring reactions equally along the vessel.

10. The floating berth of claim 6 wherein there are four breasting dolphins.

11. A method of berthing an offshore vessel at an offshore berth having a plurality of breasting dolphins and bow and stern buoys disposed in a substantially linear arrangement, the method comprising the steps of:

a. disposing the vessel in a substantially parallel orientation to the linear arrangement of breasting dolphins; providing the appearance of a traditional berth to incoming vessels;

the linear arrangement being allowed to move independently to conform to the shape of the berthing vessel;

the breasting dolphins thereby able to distribute mooring reactions equally along the vessel;

b. securing the bow of the vessel to the bow buoys;

c. securing the stern of the vessel to the stern buoy; and d. securing the vessel to at least one breasting buoy with a docking line.

12. The method of claim 11 wherein the step of securing the vessel to at least one breasting buoy further comprises contacting a portion of the vessel with a fender that is associated with the at least one breasting buoy.

13. The method of claim 11 wherein the fender is associated with the breasting buoy to form an angle with the breasting buoy and the angle is adjusted with respect to the breasting buoy to accommodate the vessel including angular-shaped hulls.

* * * * *